US011712910B2

(12) United States Patent
Abe et al.

(10) Patent No.: US 11,712,910 B2
(45) Date of Patent: Aug. 1, 2023

(54) PRINTING APPARATUS

(71) Applicant: CANON KABUSHIKI KAISHA, Tokyo (JP)

(72) Inventors: Tomohito Abe, Kanagawa (JP); Yasuyuki Asai, Tokyo (JP); Hiromasa Yoneyama, Kanagawa (JP); Ryohei Maruyama, Kanagawa (JP); Itaru Wada, Kanagawa (JP); Yoshiaki Suzuki, Chiba (JP); Tsutomu Obata, Tokyo (JP); Noriyuki Aoki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/120,645

(22) Filed: Dec. 14, 2020

(65) Prior Publication Data

US 2021/0197594 A1 Jul. 1, 2021

(30) Foreign Application Priority Data

Dec. 27, 2019 (JP) ..... 2019-239284

(51) Int. Cl.
*B65H 31/20* (2006.01)
*B41J 13/00* (2006.01)

(52) U.S. Cl.
CPC ..... *B41J 13/0009* (2013.01)

(58) Field of Classification Search
CPC ..... B65H 31/34; B65H 31/20; B41J 13/106
See application file for complete search history.

(56) References Cited

U.S. PATENT DOCUMENTS

| | | | | |
|---|---|---|---|---|
| 5,640,232 | A | 6/1997 | Miyake et al. | |
| 6,002,849 | A | 12/1999 | Koh et al. | |
| 10,272,704 | B2 * | 4/2019 | Tamai | B65H 29/70 |
| 2002/0098025 | A1 * | 7/2002 | Lee | B41J 25/308 400/59 |
| 2007/0048057 | A1 * | 3/2007 | Youn | B41J 25/308 400/58 |

FOREIGN PATENT DOCUMENTS

JP 2018-104195 A 7/2018

OTHER PUBLICATIONS

U.S. Appl. No. 17/120,422, filed Dec. 14, 2020 (First Named Inventor: Hiromasa Yoneyama).
U.S. Appl. No. 17/120,447, filed Dec. 14, 2020 (First Named Inventor: Yasuyuki Asai).

* cited by examiner

*Primary Examiner* — Lam S Nguyen
(74) *Attorney, Agent, or Firm* — Venable LLP

(57) ABSTRACT

A printing apparatus, comprising a conveyance unit for conveying a sheet, a carriage mounted with a printhead and configured to scan the printhead in a sheet widthwise direction, a platen arranged so as to face the printhead, a detection unit mounted on the carriage and configured to detect a distance to a sheet, a support portion, for supporting a sheet from below, arranged on a downstream side of the carriage in a conveyance direction, movable between a first position at which the support portion forms a conveyance surface for a sheet and a second position at which the support portion protrudes above the conveyance surface, and a determination unit configured to determine, based on a detection result of the detection unit, whether the support portion is at the first position or the second position.

16 Claims, 6 Drawing Sheets

PRINTING APPARATUS

BACKGROUND OF THE INVENTION

Field of the Invention

The present invention relates to mainly a printing apparatus.

Description of the Related Art

Japanese Patent Laid-Open No. 2018-104195 describes a structure in which a sheet (discharge target sheet hereinafter) discharged from the main body of a printing apparatus is supported from below at both end portions by a pair of left and right support portions. According to such a structure, since the discharge target sheet bends due to its own weight and this causes an inward force in a sheet widthwise direction to be applied to the discharge target sheet, a positional shift of the discharge target sheet in the sheet widthwise direction can be prevented.

Some printing apparatuses can handle various sheet widths such as the A sizes (for example, A0 size and A1 size), the B sizes (for example, B0 size and B1 size), and the like. When applying the structure described in Japanese Patent Laid-Open No. 2018-104195 to such a printing apparatus, it is conceivable to make the posture (or the state) of each support portion variable in accordance with the sheet width. On the other hand, it is also conceivable that printing is performed while the support portion is in an inappropriate posture (the posture not corresponding to the sheet width), and this may be required to be detected by the printing apparatus itself.

SUMMARY OF THE INVENTION

The present invention implements a printing apparatus that can handle various sheet widths and prevent a positional shift of a discharge target sheet with a relatively simple arrangement.

One of the aspects of the present invention provides a printing apparatus, comprising a conveyance unit configured to convey a sheet in a conveyance direction, a printing unit including a printhead that performs printing on a sheet conveyed by the conveyance unit, and configured to move the printhead in a sheet widthwise direction intersecting the conveyance direction, a platen provided so as to face the printhead, and configured to support a sheet on which the printhead performs printing, a detection unit mounted on the printing unit, and configured to detect a distance to a sheet supported by the platen, a support portion provided downstream of the printing unit in the conveyance direction, movable between a first position at which the support portion forms a conveyance surface for a sheet and a second position at which the support portion protrudes from the conveyance surface, and capable of supporting a sheet from below, and a determination unit configured to determine, based on a detection result of the detection unit, whether the support portion is at the first position or the second position.

Further features of the present invention will become apparent from the following description of exemplary embodiments (with reference to the attached drawings).

DESCRIPTION OF THE EMBODIMENTS

Figure 1:
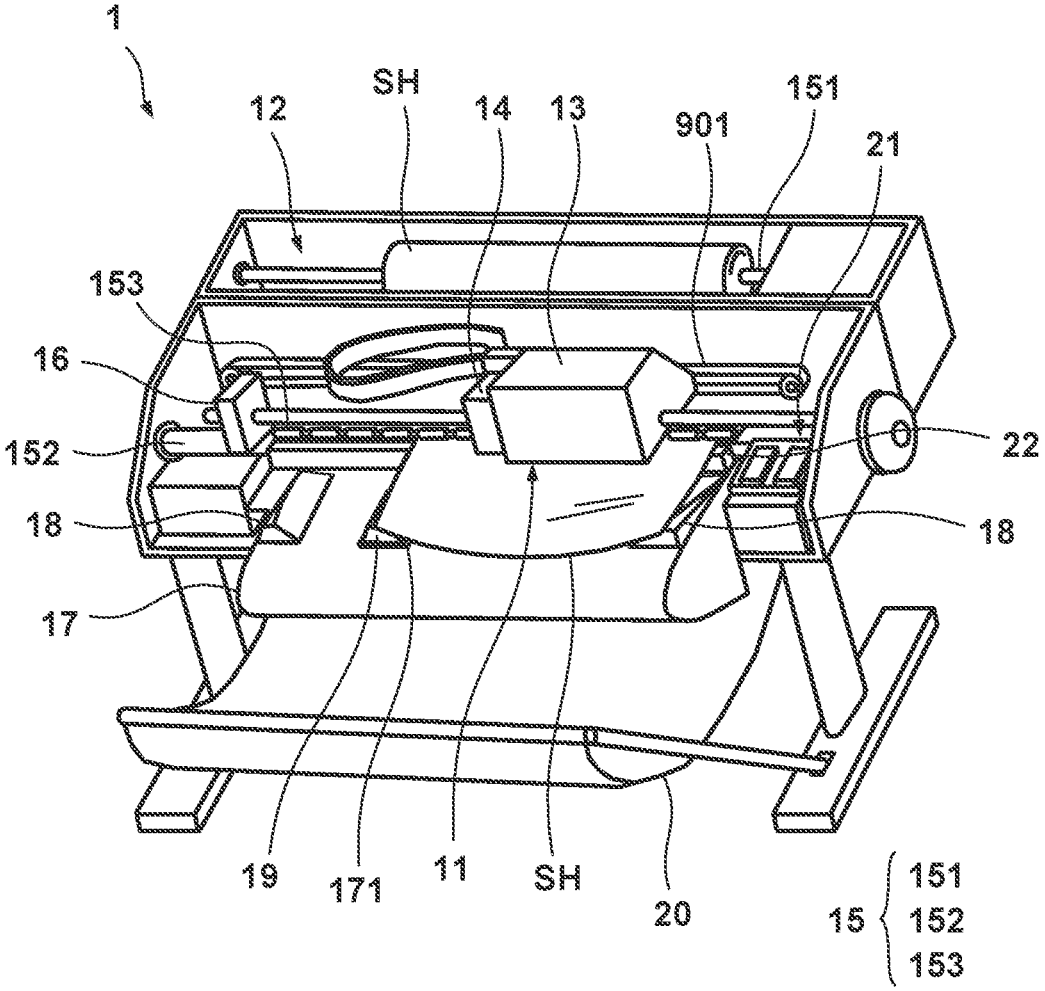
FIG. 1 is a view showing an example of the arrangement of a printing apparatus according to an embodiment.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate.

Furthermore, in the attached drawings, the same reference numerals are given to the same or similar configurations, and redundant description thereof is omitted.

First Embodiment

FIG. 1 is a schematic view showing the arrangement of a printing apparatus 1 according to an embodiment. The printing apparatus 1 includes a printhead 11, an accommodation portion 12, a carriage 13, a detection unit 14, a conveyance unit 15, a cutter unit 16, a discharge tray 17, a pair of protruding portions 18, a support portion 19, a discharge basket 20, and a system controller 21.

The printhead 11 is configured to be capable of performing printing on a sheet SH. In this embodiment, the printhead 11 is assumed to perform printing in an inkjet method, and a plurality of nozzles for discharging inks to the sheet SH are provided in the lower surface of the printhead 11. As another embodiment, the printhead 11 may employ another printing method.

The accommodation portion 12 is configured to be capable of accommodating the sheet SH serving as a print target. In this embodiment, a roll sheet (to be sometimes expressed as the roll sheet SH hereinafter) is obtained by winding the long sheet SH into a roll form. The accommodation portion 12 is configured to be capable of supporting the rotation shaft of the roll sheet SH and, in this embodiment, the accommodation portion 12 can accommodate the roll sheet SH having one of various sheet widths. With such an arrangement, the roll sheet SH can be mounted in the main body of the printing apparatus 1, and from this point of view, the accommodation portion 12 can be expressed as a roll sheet mounting portion or the like. Additionally, the accommodation portion 12 may be configured to be capable of stacking cut sheets (typically, sheets each cut with a predetermined length) having one of various sheet widths therein, and from this point of view, the accommodation portion 12 can be expressed as a cut sheet stacking portion or the like.

Note that the sheet width referred to in this specification conforms to a predetermined standard and, for the sake of easy understanding, this embodiment will be described below using, as examples, two types of sheet widths, that is, A0 size and B1 size defined in the JIS standards (Japanese Industrial Standards).

The printhead 11 is mounted on the carriage 13, and the carriage 13 is configured to be capable of scanning the printhead 11 in a sheet widthwise direction d1. The direction d1 may be expressed as the scanning direction d1. In this embodiment, the carriage 13 can scan in the direction d1 by a moving mechanism 901 based on the power of an electric motor 13M (see FIG. 3). Printing is performed by the printhead 11 discharging the inks to the sheet SH during the scanning. A known belt mechanism, a slider mechanism, or the like may be used as the moving mechanism 901.

Here, the printing apparatus 1 further includes a platen 22. The platen 22 is arranged so as to face the printhead 11, and supports the sheet SH on which printing is performed by the printhead 11. This can improve printing accuracy. A suction hole connected to a suction fan (not shown) is provided in the upper surface (obverse surface) of the platen 22, and the sheet SH can be sucked to the upper surface of the platen 22 by the negative-pressure suction of the suction hole. This reduces or suppresses floating of the sheet SH from the platen 22, and the sheet SH can be maintained in the horizontal posture (to be flat). Alternatively, an arrangement may be employed in which the sheet SH is pressed against the upper surface of the platen 22 by applying a wind pressure to the upper surface of the sheet SH.

The detection unit 14 is configured to be capable of detecting floating of the sheet SH from the upper surface of the platen 22. In this embodiment, the detection unit 14 detects the distance to the sheet SH supported by the platen 22, and the detection result (the detection value or the output value) changes in accordance with the distance. The detection unit 14 is mounted on the carriage 13, and is scanned by the carriage 13 together with the printhead 11. For example, during the scanning by the carriage 13, the detection unit 14 can detect whether the sheet SH is in the horizontal state in the entire area in the sheet widthwise direction d1, and detects a so-called jam (wrinkles that can be generated in the sheet SH, or a paper jam in a case of paper) and the like. The details will be described later. As the detection unit 14, a sensor that can detect reflected light from the sheet SH, for example, a CCD/CMOS image sensor or the like, or a sensor that can measure the distance to the upper surface (or the printing surface) of the sheet SH, for example, a gap sensor, an infrared sensor, an ultrasonic sensor, or the like, can be used.

The conveyance unit 15 is configured to be capable of conveying the sheet SH in a direction d2 intersecting the sheet widthwise direction d1. The direction d2 may be expressed as the conveyance direction d2. The conveyance unit 15 may be formed by a known conveyance mechanism, and in this embodiment, includes conveyance rollers 151 and 152 and a driven roller 153. The conveyance roller 151 conveys the leading end portion of the sheet SH toward the downstream side by rotating the roll sheet SH based on the power of an electric motor 15M (see FIG. 3). The conveyance roller 152 further conveys the sheet SH toward the downstream side by rotation based on the power of the electric motor 15M while nipping the sheet SH together with the driven roller 153. The conveyance roller 152 is provided on the downstream side of the conveyance roller 151, and in this embodiment, can be provided at a position below the carriage 13 (or the detection unit 14) or on the upstream side of this position.

Note that in this specification, the downstream side indicates the side in the conveyance direction d2 (forward direction) in the conveyance path of the sheet SH by the conveyance unit 15, and the upstream side indicates the side in the direction opposite to the conveyance direction d2 in the conveyance path.

The cutter unit 16 is configured to be capable of cutting the roll sheet SH to a predetermined length and, for example, installed so as to be detachable from the carriage 13 in the end portion of a region where the carriage 13 can pass. This installation position is used as the standby position of the cutter unit 16. When the roll sheet SH is to be cut, the carriage 13 moves to the standby position, connects with the cutter unit 16, and scans the cutter unit 16, thereby cutting the roll sheet SH. When the roll sheet SH is not to be cut, the carriage 13 scans the cutter unit 16 to the standby position, releases the connection with the cutter unit 16, and causes the cutter unit 16 to wait at the standby position.

Note that the connection with the cutter unit 16 and disconnection may be implemented by a known connection mechanism, and may be implemented by either a mechanical mechanism or an electric mechanism.

The discharge tray 17 is configured to be capable of receiving the sheet SH (to be sometimes expressed as the discharge target sheet SH hereinafter) conveyed by the conveyance unit 15 and discharged from the main body of the printing apparatus 1. The discharge target sheet SH can be stacked on the discharge tray 17 if the sheet length is a relatively small size, or can pass through the discharge tray 17 and be discharged to the discharge basket 20 if the sheet length is a relatively large size. The details will be described later.

The pair of protruding portions 18 and the support portion 19 are provided in the discharge tray 17. The pair of protruding portions 18 are provided so as to face each other at the both sides of the support portion 19, and in this embodiment, are provided in the both side portions of the discharge tray 17. Each protruding portion 18 may be expressed as a discharge guide, or may be simply expressed as a guide or the like. Further, since each protruding portion 18 has a function of supporting the sheet SH, it may be expressed as a support portion. The support portion 19 is provided at a predetermined position between the pair of protruding portions 18 so as to be storable, and is configured to be capable of supporting the sheet SH from below by standing up the support portion 19 to a position higher than the stored position. That is, a user of the printing apparatus 1 can set the support portion 19 in the stored posture or the standing posture.

Note that the posture change of the support portion 19 is manually implemented in this embodiment, but it may be electrically implemented as another embodiment. The support portion 19 may be configured such that its posture can be changed by a typical operation by the user, and may be configured such that its posture can be changed by, for example, a drawing operation, a pressing operation, and the like.

Here, the discharge tray 17 is provided with a recess portion (recess) 171 that can store the support portion 19 by fitting. That is, the stored posture of the support portion 19 corresponds to a state in which the support portion 19 is stored in the recess portion 171, and the standing posture of the support portion 19 corresponds to a state in which the support portion 19 stands upright from the recess portion 171. In the stored posture, the upper surface or upper end of the support portion 19 is flush with or lower than the peripheral portion of at least the recess portion 171 in the discharge tray 17, and in the standing posture, it protrudes from the peripheral portion.

Here, for the sake of descriptive convenience, the posture of the support portion 19 is expressed as the stored posture or the standing posture, but it can be said that the support portion 19 can move between a position (first position) flush with or lower than the conveyance surface for the sheet and a position (second position) above the conveyance surface.

Note that in FIG. 1, the mode viewed from the upstream-side direction (the mode viewed in the direction opposite to the conveyance direction d2) is the front surface, and the mode viewed from the downstream-side direction (the mode viewed in the direction d2) is the back surface. In this specification, the positional relationship between components is described based on the relative position described above. For example, the term "side" indicates the positional relationship in which components are adjacent to or apart from each other in the direction d1. Further, for example, the term "above/below" indicates the positional relationship in which components are adjacent to or apart from each other in the direction orthogonal to both the directions d1 and d2.

Figure 2A:
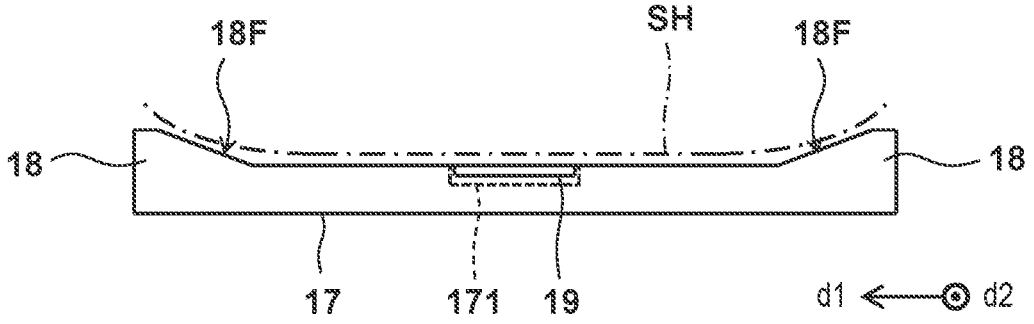
FIGS. 2A and 2B are views each showing an example of the state of a sheet in a discharge tray.
Figure 2B:
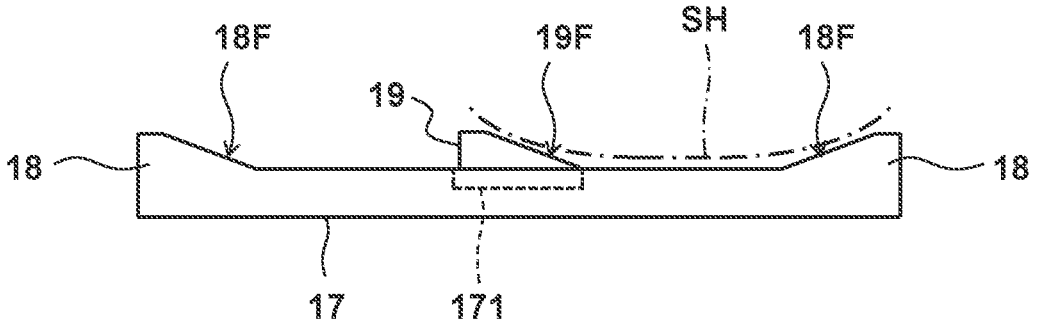

FIG. 2A shows a front schematic view of the printing apparatus 1 (mainly the discharge tray 17) in a case in which the support portion 19 is in the stored posture, and FIG. 2B shows a front schematic view in a case in which the support portion 19 is in the standing posture.

According to the arrangement of this embodiment, for example, when the support portion 19 is stored, the sheet SH having a sheet width of a relatively large size (here, the sheet width corresponding to A0 size) is supported from below in the both side portions by the pair of protruding portions 18, and appropriately bends in the central portion due to its own weight (see FIG. 2A). Further, for example, when the support portion 19 stands upright, the sheet SH having a sheet width of a relatively small size (here, the sheet width corresponding to B1 size) is supported from below in the both side portions by one of the pair of protruding portions 18 and the support portion 19, and appropriately bends in the central portion due to its own weight (see FIG. 2B). Thus, even when the sheet size is either of the two types described above, the sheet SH is discharged onto the discharge tray 17 in a state in which a positional shift in the sheet widthwise direction d1 is prevented.

In order to further appropriately prevent the positional shift by allowing the sheet SH to appropriately bend, each of the pair of protruding portions 18 preferably includes an inclined surface 18F on the inward side. That is, the upper surface of each of the pair of protruding portions 18 is inclined so as to be low on the inward side in the discharge tray 17 and high on the outward side. Alternatively or additionally, the support portion 19 preferably includes an inclined surface 19F on at least one side in the sheet widthwise direction d1. In this embodiment, the upper surface of the support portion 19 is inclined so as to be low on the side of one of the pair of protruding portions 18 and high on the opposite side.

Here, the pair of protruding portions 18 and the support portion 19 are provided in the discharge tray 17 in this embodiment, but their installation positions may be changed as another embodiment. That is, the pair of protruding portions 18 and the support portion 19 need only be provided in anywhere in the discharge path for discharging the printed sheet SH having undergone printing (or the sheet SH having passed below the printhead 11) from the main body of the printing apparatus 1, for example, provided on the downstream side of at least the carriage 13.

The discharge basket 20 is provided below the main body of the printing apparatus 1 and below the discharge tray 17. Since the discharge target sheet SH having a sheet length of a relatively large size is difficult to be stacked on the discharge tray 17, the discharge basket 20 receives such the discharge target sheet SH. The discharge basket 20 can be folded when not in use.

The system controller 21 controls driving of the entire system of the printing apparatus 1. The system controller 21 may be implemented by a single unit, or may be implemented by two or more units electrically connected to each other so as to be capable of communicating with each other. The system controller 21 may be formed by a semiconductor device such as an ASIC (Application Specific Integrated Circuit) or a PLD (Programmable Logic Device), or may be formed by a CPU (Central Processing Unit) and a memory. That is, the function of the system controller 21 can be implemented by either hardware or software. Note that the system controller 21 may be simply referred to as a controller, or may be referred to as a processor or the like.

Figure 3:
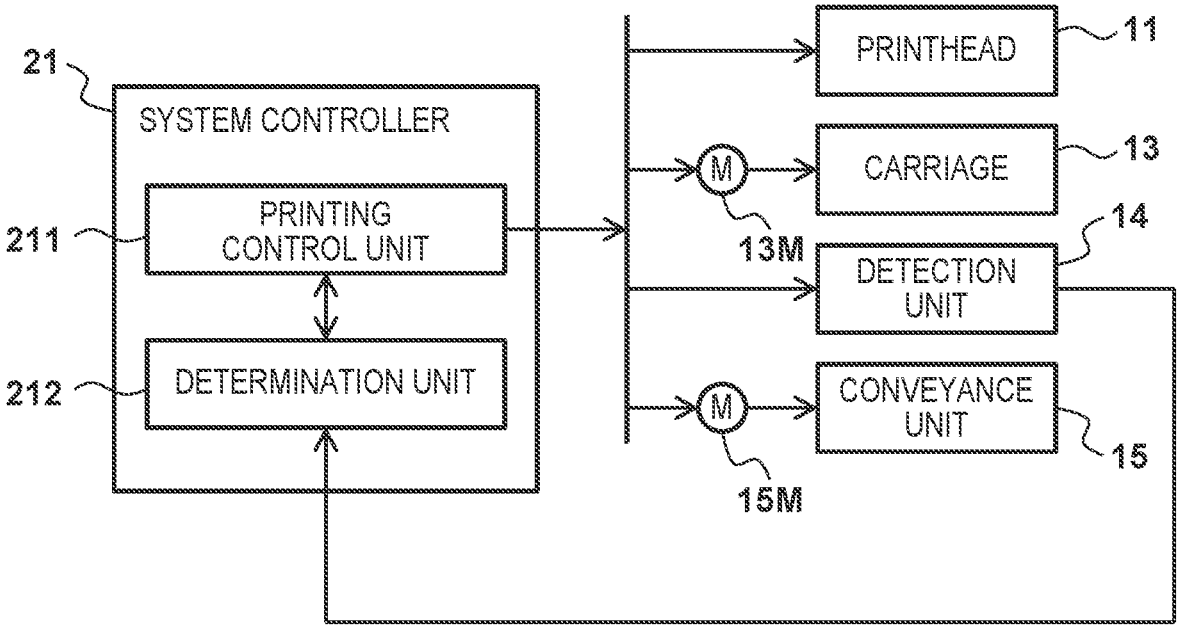
FIG. 3 is a block diagram showing an example of the arrangement of the printing apparatus.

FIG. 3 is a block diagram showing the arrangement of the printing apparatus 1. The system controller 21 includes a printing control unit 211 and a determination unit 212.

The printing control unit 211 performs printing on the sheet SH by controlling driving of each of the printhead 11, the carriage 13, the detection unit 14, and the conveyance unit 15. For example, the printing control unit 211 drives the conveyance unit 15 using the electric motor 15M to convey the roll sheet SH, and performs printing on the roll sheet SH while causing the carriage 13 to scan the printhead 11 using the electric motor 13M. After the printing is completed, the printing control unit 211 scans the carriage 13 to the standby position of the cutter unit 16, and connects the cutter unit 16 to the carriage 13. Thereafter, the printing control unit 211 causes the carriage 13 to scan the cutter unit 16 to cut the roll sheet SH and discharge it from the printing apparatus 1. The cut sheet SH is discharged onto the discharge tray 17 or to the discharge basket 20. Further, it is also possible that, after causing the carriage 13 to scan the cutter unit 16 to the standby position and releasing the connection of the cutter unit 16 at the standby position to set the cutter unit 16 in the standby state, the printing control unit 211 starts next printing.

The determination unit 212 determines, based on the detection result of the detection unit 14 obtained by scanning by the carriage 13, whether the support portion 19 is in the stored posture or the standing posture. That is, the detection unit 14 mounted on the carriage 13 detects floating of the sheet SH upon scanning by the carriage 13. The determination unit 212 determines, based on the floating mode of the sheet SH indicated by the detection result, whether the support portion 19 is in the stored posture or the standing posture. The details will be described later. The printing control unit 211 performs printing based on the determination result of the determination unit 212.

Figure 4:
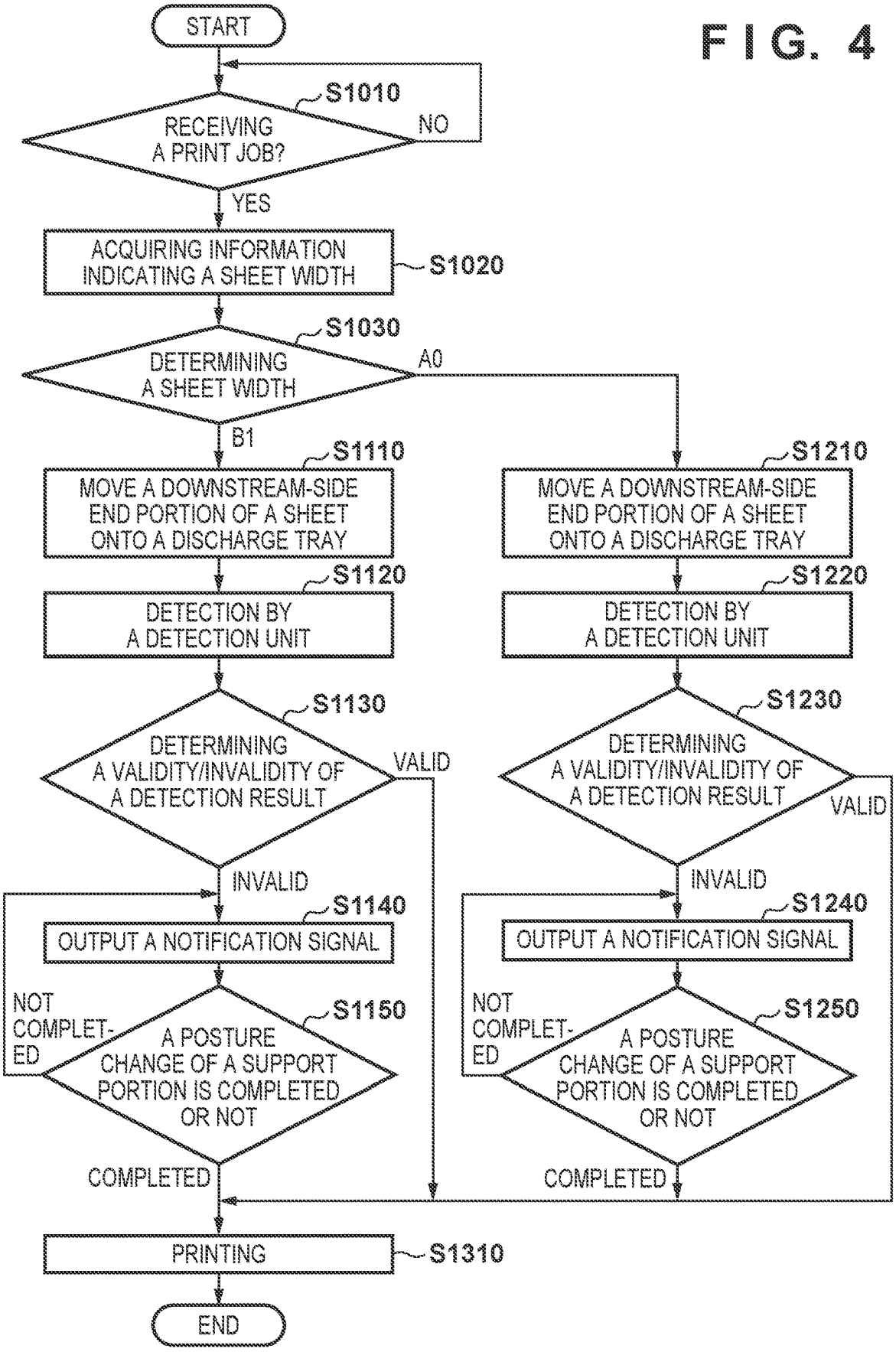
FIG. 4 is a flowchart illustrating an example of the contents of control of the printing apparatus.

FIG. 4 is a flowchart illustrating the contents of control of the printing apparatus 1 according to this embodiment. This control is implemented by mainly the system controller 21 (the printing control unit 211 and the determination unit 212). The overview of the control is that the posture of the support portion 19 is determined based on the detection result of the detection unit 14 obtained by scanning by the carriage 13 and, based on the determination result, printing is started or a notification to set the support portion 19 in the posture corresponding to the sheet width is given.

In step S1010 (this is simply referred to as "S1010" hereinafter, and the same applies to other steps), it is determined whether a print job is received. The print job is an instruction command or an instruction signal indicating that printing is performed on the sheet SH and, for example, transmitted to the printing apparatus 1 from a computer connected to the printing apparatus 1 by a wired or wireless connection. If a print job is received, the process advances to S1020; otherwise, the process returns to S1010.

In S1020, information indicating the sheet width of the sheet SH is acquired. The information can be obtained in various methods. For example, the print job may include information indicating the sheet size, and information indicating the sheet width of the sheet SH may be acquired in S1020 based on the print job received in S1010. Alternatively, for example, a sensor for measuring the sheet width may be provided in the accommodation portion 12, and information indicating the sheet width of the sheet SH may be acquired in step S1020 based on the measurement result of the sensor.

In S1030, the sheet width is determined based on the information acquired in S1020. As has been described above, for the sake of easy understanding, the sheet width is determined to be either of the two sheet widths of A0 size and B1 size in this embodiment. The process advances to S1110 if the sheet width is B1 size, and the process advances to S1210 if the sheet width is A0 size.

In S1110, the conveyance unit 15 conveys the sheet SH and locates at least the downstream-side end portion of the sheet SH on the support portion 19 of the discharge tray 17, and in this state, the conveyance unit 15 stops conveyance of the sheet SH and fixes the position of the sheet SH. In this step, the printing control unit 211 functions as a first control unit that, before printing by the printhead 11 is started, causes the conveyance unit 15 to convey the sheet SH until at least the downstream-side end portion of the sheet SH is located on the support portion 19.

In S1120, in the state in S1110, the detection unit 14 detects floating of the sheet SH during scanning by the carriage 13. Note that in S1120, scanning by the carriage 13 is performed in a state in which driving of the printhead 11 is suppressed, that is, printing on the sheet SH is not practically performed. In this step, the printing control unit 211 functions as a second control unit that causes the detection unit 14 to perform the detection while scanning by the carriage 13 is performed in a state in which at least the downstream-side end portion of the sheet SH is located on the support portion 19.

In S1130, the validity/invalidity of the detection result by the detection unit 14 obtained in S1120 is determined. More specifically, it is determined whether the support portion 19 is in the stored posture or the standing posture. Here, since the sheet width is determined to be B1 size in S1030, the support portion 19 is required to be in the standing posture (see FIG. 2B). If the detection result is valid (the support portion 19 is in the standing posture), the process advances to S1310, and if the detection result is invalid (the support portion 19 is in the stored posture), the process advances to S1140. The details will be described later.

Since it is determined in S1130 that the support portion 19 is not in the posture (here, the standing posture) corresponding to the sheet width, a predetermined notification signal is output in S1140. This notification may be performed by, for example, a display unit (a liquid crystal display, an organic EL (Electro-luminescence) display, or the like) or a light emitting unit (an LED (Light Emitting Diode) or the like) that can be provided in the printing apparatus 1. Thus, the user is notified that the support portion 19 should be changed to the posture (here, the standing posture) corresponding to the sheet width.

In S1150, it is determined whether the posture change of the support portion 19 is completed. This determination may be performed based on an operation input from the user, or may be performed based on detecting, by the detection unit 14, floating of the sheet SH in a procedure similar to that in S1120. If the posture change of the support portion 19 is completed, the process advances to S1310; otherwise, the process returns to S1140.

In S1210, the conveyance unit 15 conveys the sheet SH and locates at least the downstream-side end portion of the sheet SH on the support portion 19 of the discharge tray 17, and in this state, the conveyance unit 15 stops conveyance of the sheet SH and fixes the position of the sheet SH (as in S1110).

In S1220, in the state in S1210, the detection unit 14 detects floating of the sheet SH during scanning by the carriage 13 (as in S1120).

In S1230, the validity/invalidity of the detection result by the detection unit 14 obtained in S1220 is determined. More specifically, it is determined whether the support portion 19 is in the stored posture or the standing posture (as in S1130). Here, since the sheet width is determined to be A0 size in S1030, the support portion 19 is required to be in the stored posture (see FIG. 2A). If the detection result is valid (the support portion 19 is in the stored posture), the process advances to S1310, and if the detection result is invalid (the support portion 19 is in the standing posture), the process advances to S1240. The details will be described later.

Since it is determined in S1230 that the support portion 19 is not in the posture (here, the stored posture) corresponding to the sheet width, a predetermined notification signal is output in S1240 (as in S1140). Thus, the user is notified that the support portion 19 should be changed to the posture (here, the stored posture) corresponding to the sheet width.

In S1250, it is determined whether the posture change of the support portion 19 is completed (as in S1150). If the posture change of the support portion 19 is completed, the process advances to S1310; otherwise, the process returns to S1240.

In S1310, after the sheet SH is conveyed by the conveyance unit 15 to a predetermined position (for example, a position where the position to start printing on the sheet SH is located below the printhead 11), printing to the sheet SH by the printhead 11 is performed. In this step, the printing control unit 211 functions as a third control unit that starts printing by the printhead 11 based on the determination result by the determination unit 212. When the printing is completed, this flowchart is terminated.

As has been described above, as the detection unit 14, a sensor that can detect reflected light from the sheet SH or a sensor that can measure the distance to the upper surface (or the printing surface) of the sheet SH can be used. Accordingly, the detection unit 14 can detect presence/absence of the sheet SH being conveyed by the conveyance unit 15. For example, if the sheet SH is present, reflected light having a relatively high brightness is detected, but if the sheet SH is absent, reflected light having a relatively low brightness is detected. Alternatively, for example, if the sheet SH is present, a relatively small distance is measured, but if the sheet SH is absent, a relatively large distance (the distance larger by the amount corresponding to the thickness of the sheet SH) is measured. Accordingly, the detection unit 14 can acquire the positions of both ends of the sheet SH, that is, in step S1020, information indicating the sheet width of the sheet SH can be directly acquired by scanning the detection unit 14 by the carriage 13. Therefore, as another example, S1020 may be omitted, and the contents as in S1020 may be performed in S1120.

Note that in this embodiment, for the sake of easy understanding, the contents of this flowchart have been described using, as examples, two types of sheet widths, that is, A0 size and B1 size defined in the JIS standards, but the similar contents apply to a case in which three or more types of sheet widths are used.

Figure 5A:
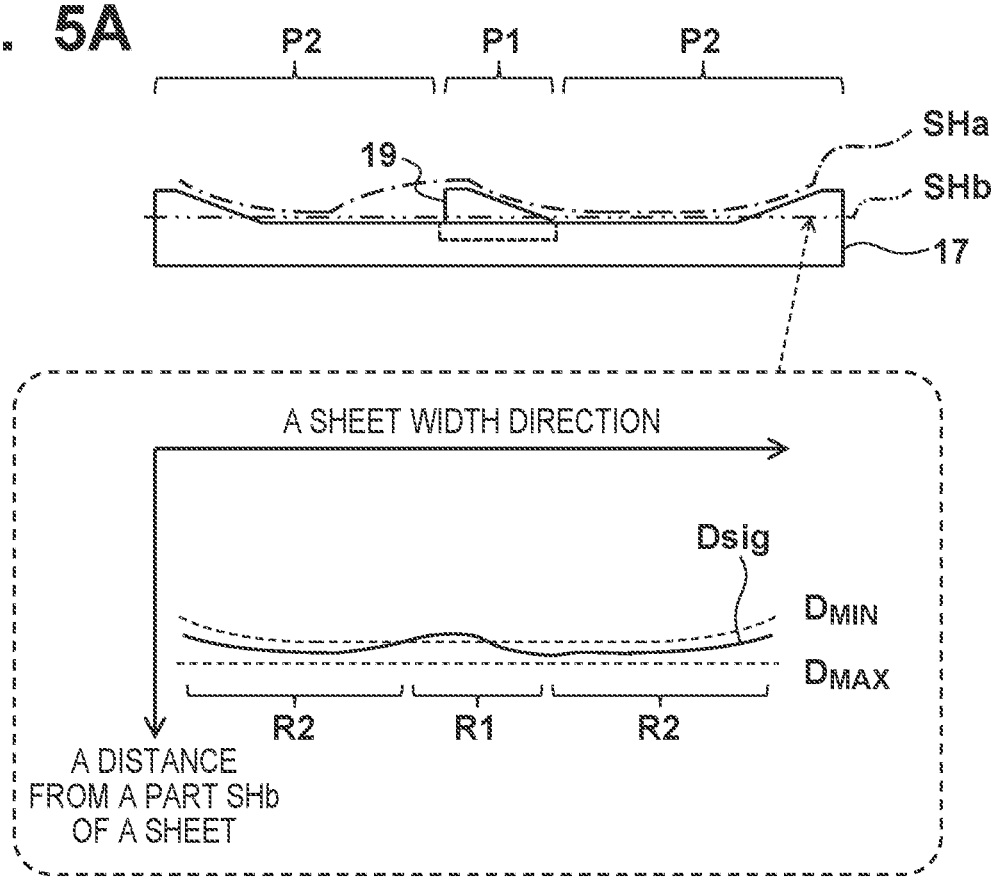
FIGS. 5A and 5B are views each showing an example of the detection result by a detection unit and the determination result by a determination unit.
Figure 5B:
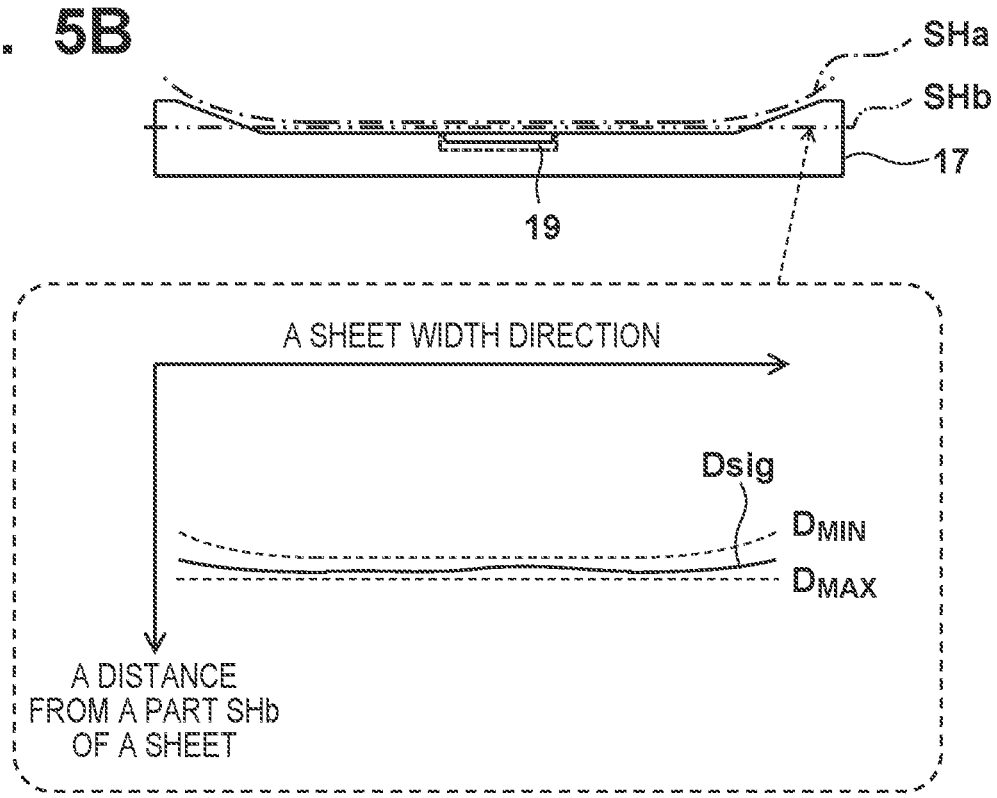

FIG. 5A is a front schematic view showing the state of the sheet SH in a case in which the support portion 19 is in the standing posture when printing is performed on the sheet SH having a sheet width of a relatively large size. FIG. 5B is a front schematic view showing the state of the sheet SH in a case in which the support portion 19 is in the stored posture when printing is performed on the sheet SH having a sheet width of a relatively large size. In each of FIGS. 5A and 5B, the alternate long and short dashed line indicates the section of a part (to be referred to as a part SHa) of the sheet SH on the discharge tray 17, and the alternate long and two short dashed line indicates the section of a part (a part on the upstream side of the part SHa, and to be referred to as a part SHb) located below the detection unit 14. Note that as for the part SHb, a distribution Dsig indicating the distance from the detection unit 14 to the part SHb is shown as the detection result of the detection unit 14, and its allowable range between $D_{MIN}$ and $D_{MAX}$ is also shown. The details will be described later.

Here, if the sheet width is a relatively large size, the support portion 19 is preferably set in the stored posture. Then, the sheet SH is supported from below in the both side portions by the pair of protruding portions 18, and appropriately bends in the central portion due to its own weight (see FIG. 2A). As a result, the sheet SH is discharged onto the discharge tray 17 in a state in which a positional shift in the sheet widthwise direction d1 is prevented.

However, in the example shown in FIG. 5A, since the support portion 19 is in the standing posture, the part SHa of the sheet SH is in an unintended posture, and it can be seen from the detection result of the detection unit 14 that the part SHb influenced by the part SHa is also in an unintended posture. This can cause a decrease in quality of printing, in addition to a positional shift of the sheet SH in the sheet widthwise direction d1. According to this embodiment, the determination unit 212 can appropriately determine, based on whether the detection result of the detection unit 14 satisfies a predetermined criterion, whether the posture of the support portion 19 is the posture corresponding to the sheet width (see FIG. 4). The further details will be described later.

Figure 6A:
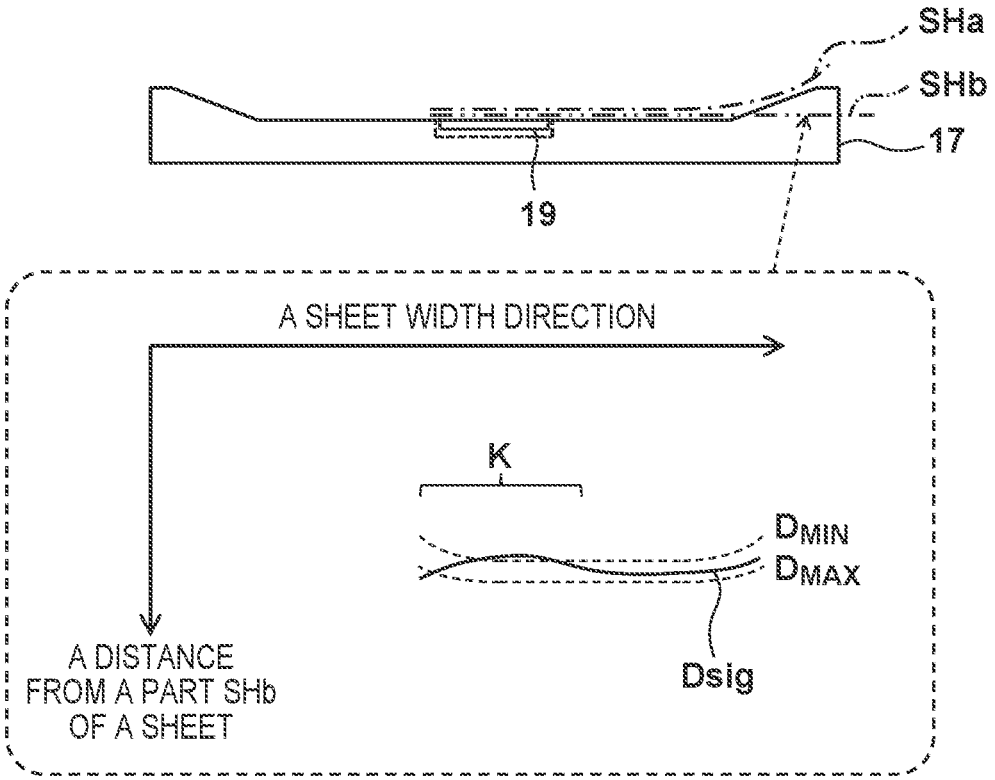
FIGS. 6A and 6B are views each showing another example of the detection result by the detection unit and the determination result by the determination unit.
Figure 6B:
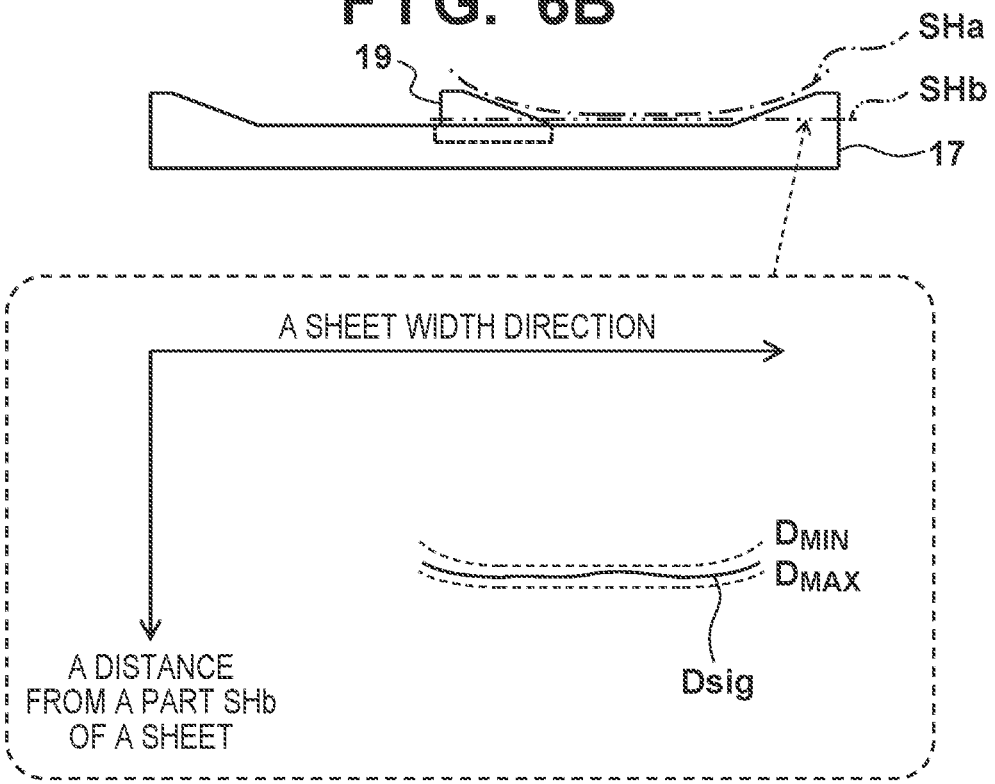

FIG. 6A is a front schematic view showing the state of the sheet SH in a case in which the support portion 19 is in the stored posture when printing is performed on the sheet SH having a sheet width of a relatively small size. FIG. 6B is a front schematic view showing the state of the sheet SH in a case in which the support portion 19 is in the standing posture when printing is performed on the sheet SH having a sheet width of a relatively small size. In each of FIGS. 6A and 6B, as in FIGS. 5A and 5B, the alternate long and short dashed line indicates the section of the part SHa of the sheet SH on the discharge tray 17, and the alternate long and two short dashed line indicates the section of the part SHb located below the detection unit 14.

Here, if the sheet width is a relatively small size, the support portion 19 is preferably set in the standing posture. Then, the sheet SH is supported from below in the both side portions by one of the pair of protruding portions 18 and the support portion 19, and appropriately bends in the central portion due to its own weight (see FIG. 2B). As a result, the sheet SH is discharged onto the discharge tray 17 in a state in which a positional shift in the sheet widthwise direction d1 is prevented.

However, in the example shown in FIG. 6A, since the support portion 19 is in the stored posture, the part SHa of the sheet SH is in an unintended posture, and it can be seen from the detection result of the detection unit 14 that the part SHb influenced by the part SHa is also in an unintended posture. Further, in the example shown in FIG. 6A, a positional shift of the sheet SH in the direction d1 may occur on the discharge tray 17. As in the example shown in FIG. 5A, these can cause a decrease in quality of printing, in addition to a positional shift of the sheet SH in the sheet widthwise direction d1. According to this embodiment, the determination unit 212 can appropriately determine, based on whether the detection result of the detection unit 14 satisfies a predetermined criterion, whether the posture of the support portion 19 is the posture corresponding to the sheet width (see FIG. 4). The further details will be described later.

Further, in the example shown in FIG. 6A, as shown as a floating portion K, it is conceivable that the central portion of the sheet SH is curved upward and becomes floating due to printing on the sheet SH. Therefore, according to this embodiment, in some cases, it can be further appropriately determined whether the posture of the support portion 19 is the posture corresponding to the sheet width.

As shown in an enlarged view of each of FIGS. 5A to 6B, for example, the distribution Dsig, in the sheet widthwise direction d1, of the distance to the upper surface of the sheet SH is obtained as the detection result of the detection unit 14. Whether the detection result of the detection unit 14 satisfies the predetermined criterion may be determined based on, for example, whether the distribution Dsig satisfies that it is larger than the allowable lower limit value $D_{MIN}$ and smaller than the allowable upper limit value $D_{MAX}$.

The allowable lower limit value $D_{MIN}$ and the allowable upper limit value $D_{MAX}$ can change in accordance with the type of the sheet SH. Therefore, for example, the user may input, in advance, information indicating the type of the sheet SH to the printing apparatus 1, and the allowable lower limit value $D_{MIN}$ and the allowable upper limit value $D_{MAX}$ may be set based on the information.

In addition, the allowable lower limit value $D_{MIN}$ and the allowable upper limit value $D_{MAX}$ can change in accordance with the environment (for example, temperature, humidity, or the like) of the printing apparatus 1. Therefore, for example, a sensor (for example, a temperature sensor, a humidity sensor, or the like) which can detect the environment of the printing apparatus 1 may be provided in the printing apparatus 1, and the allowable lower limit value $D_{MIN}$ and the allowable upper limit value $D_{MAX}$ may be set based on the detection result of the sensor.

Here, as shown in FIG. 5A, of the conveyance path of the sheet SH, a part in the direction d1 where the support portion 19 is located is referred to as a part (first part) P1, and a part other than the part P1 is referred to as a part (second part) P2. At this time, the detection result of the detection unit 14 can be divided into a result (first result) R1 corresponding to the part P1 and a result (second result) R2 corresponding to the part P2.

For example, the determination unit 212 can determine, based on the result R1, whether the support portion 19 is in the stored posture or the standing posture, and further determine whether the posture of the support portion 19 is the posture corresponding to the sheet width. That is, the determination unit 212 can perform the above-described determination by referring to not the entire detection result but only a part of the detection result of the detection unit 14. Therefore, as another embodiment, detection of floating of the sheet SH by the detection unit 14 may be performed only while the detection unit 14 passes above the part P1 in front view by scanning by the carriage 13.

On the other hand, the determination unit 212 can determine, based on the result R2, the conveyed state of the sheet SH in the above-described conveyance path. For example, the determination unit 212 can also determine the state of a part of the sheet SH, which is not easily influenced by the posture of the support portion 19. Therefore, the determination unit 212 can determine whether a jam has occurred.

As has been described above, according to this embodiment, the support portion 19 is provided on the downstream side of the carriage 13 in the conveyance path of the sheet SH by the conveyance unit 15 (in this embodiment, provided in the discharge tray 17) so as to be storable and capable of supporting the sheet from below by standing upward. The determination unit 212 determines, based on the detection result of the detection unit 14 obtained by scanning by the carriage 13, whether the support portion 19 is in the stored posture or in the standing posture. That is, the determination unit 212 determines whether the support portion 19 is in the posture corresponding to the sheet width. If it is determined that the support portion 19 is not in the posture corresponding to the sheet width, the determination unit 212 outputs a predetermined notification signal to notify the user that posture change of the support portion 19 is required.

According to the arrangement as described above, it becomes possible that the detection unit 14 for detecting occurrence of a job also has a function of detecting the posture of the support portion 19. Accordingly, it is unnecessary to newly provide the support portion 19 with another detection unit for detecting the posture of the support portion 19. Therefore, according to this embodiment, it is possible to implement the printing apparatus 1 that can handle various sheet widths and prevent a positional shift of a discharge target sheet with a relatively simple arrangement (or with relatively low cost).

The arrangement in which the single support portion 19 is provided has been exemplified in this embodiment, but the number of the support portions 19 may be two or more as another embodiment. With this arrangement, the printing apparatus 1 is configured to be capable of handling a wider variety of sheet widths.

As still another embodiment, a pair of support portions (which are configured to be capable of posture change, similar to the support portion 19) may be provided instead of the pair of protruding portions 18. In this case, the user can set, in the standing posture, only two of the plurality of support portions 19 that correspond to the sheet width. The effect similar to that described above can also be obtained with this arrangement.

Second Embodiment

Figure 7:
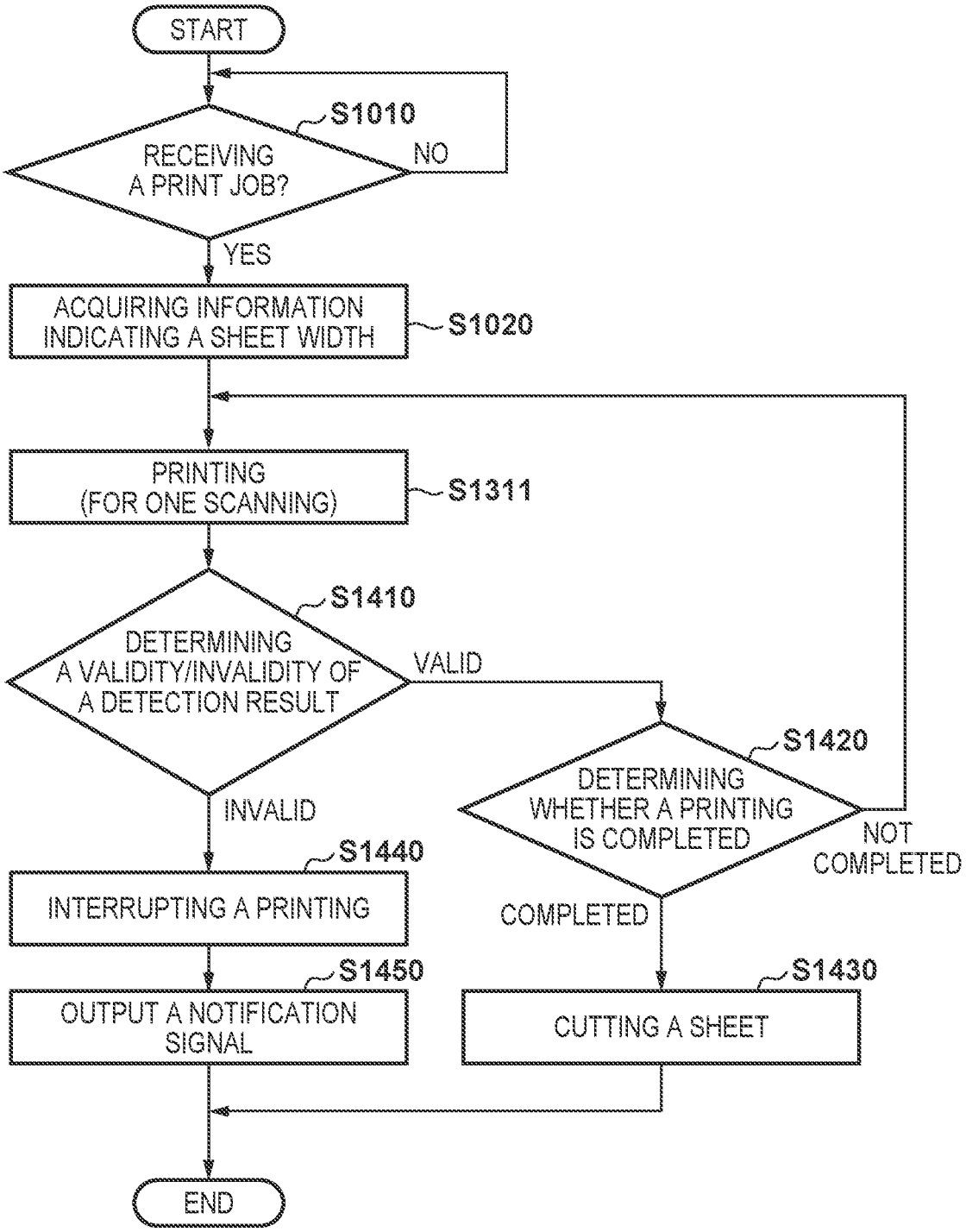
FIG. 7 is a flowchart illustrating another example of the contents of control of the printing apparatus.

The first embodiment described above has exemplified the mode in which determination as to whether the posture of the support portion 19 is the posture corresponding to the sheet width is performed before printing is started, but the determination may be performed during printing. FIG. 7 is a flowchart illustrating the contents of control of a printing apparatus 1 according to the second embodiment. Since S1010 and S1020 are similar to those in the first embodiment, the description thereof will be omitted here.

In S1311, printing is performed for one scanning. During the scanning, a detection unit 14 detects floating of a sheet SH (as in S1120 and S1220). Here, one scanning indicates scanning of a printhead 11 in a direction d1 by a carriage 13. Alternatively, one scanning may indicate, in addition to/instead of scanning of the printhead 11 in the direction d1, scanning of the printhead 11 in a direction opposite to the direction d1. From another point of view, it can be said that printing (discharge of ink) may be performed in the forward direction, in the backward direction, or in both the forward direction and the backward direction.

In S1410, the validity/invalidity of the detection result by the detection unit 14 obtained in S1311 is determined. More specifically, it is determined whether a support portion 19 is in a stored posture or a standing posture (as in S1130 and S1230). For example, if the information obtained in S1020 indicates that the sheet width is A0 size, the support portion 19 is required to be in the stored posture (see FIG. 2A). Therefore, if the detection result is valid (the support portion 19 is in the stored posture), the process advances to S1420, and if the detection result is invalid (the support portion 19 is in the standing posture), the process advances to S1440.

On the other hand, if the information obtained in S1020 indicates that the sheet width is B1 size, the support portion 19 is required to be in the standing posture (see FIG. 2B). Therefore, if the detection result is valid (the support portion 19 is in the standing posture), the process advances to S1420, and if the detection result is invalid (the support portion 19 is in the stored posture), the process advances to S1440.

In S1420, it is determined whether the printing based on the print job received in S1010 is completed. If the printing is completed, the process advances S1430; otherwise, the process returns to S1311 (the printing is continued by performing next scanning).

In S1430, the printed sheet SH is cut from the roll sheet SH using a cutter unit 16, and the sheet SH is discharged from a discharge tray 17.

Since the detection result by the detection unit 14 is determined to be invalid in S1410, the printing is interrupted in S1440. Additionally, the sheet SH on which the printing is interrupted may be cut from the roll sheet SH by the cutter unit 16 and discharged from the discharge tray 17.

Since it is determined in S1410 that the support portion 19 is not in the posture (the stored posture if the sheet width is A0 size, or the standing posture if the sheet width is B1 size) corresponding to the sheet width, a predetermined notification signal is output in S1450 (as in S1140 and S1240). Thus, the user is notified that posture change of the support portion 19 is required.

According to this embodiment, determination as to whether the posture of the support portion 19 is the posture corresponding to the sheet width is performed during printing, and the effect similar to that in the first embodiment can be obtained even after the printing is started. Note that the first and second embodiments can be combined, that is, the determination may be performed both before and after the printing is started.

(Others)

The modes described in the above-described embodiments are merely examples, and the present invention is not limited thereto. Further, the printing apparatus 1 may be a single-function printer having only a printing function, or a multifunction printer having a plurality of functions such as a printing function, a fax function, and a scanner function. Furthermore, the printing apparatus 1 may be, for example, a manufacturing apparatus for manufacturing a color filter, an electronic device, an optical device, a microstructure, or the like by a predetermined printing method.

The term "printing" in this specification should be interpreted in a broad sense. Accordingly, the mode of "printing" does not matter whether the object formed on a print medium is significant information such as characters and graphics, and also does not matter whether the object is visualized so that a human can visually perceive it.

Further, "printing medium" should be interpreted in a broad sense, similar to "printing" described above. The concept of "print medium" can include, in addition to paper which is generally used, any member that can accept ink, such as cloth, a plastic film, a metal plate, glass, ceramics, a resin, wood, leather, and the like.

Furthermore, "ink" should be interpreted in a broad sense, similar to "printing" described above. Accordingly, the concept of "ink" can include, in addition to a liquid that forms an image, a figure, a pattern, or the like by being applied onto a print medium, additional liquids that can be used for processing a print medium, processing ink (for example, coagulation or insolubilization of colorants in ink applied onto a print medium), or the like. Therefore, the printing apparatus 1 may be expressed as a liquid discharge apparatus or the like.

(Program)

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-239284, filed on Dec. 27, 2019, which is hereby incorporated by reference herein in its entirety.

What is claimed is:

1. A printing apparatus comprising:

a conveyance unit configured to convey a sheet in a conveyance direction;

a printing unit including a printhead that performs printing on a sheet conveyed by the conveyance unit, and configured to move the printhead in a sheet widthwise direction intersecting the conveyance direction;

a platen provided so as to face the printhead, and configured to support a sheet on which the printhead performs printing;

a detection unit mounted on the printing unit, and configured (a) to detect a distance to a sheet supported by the platen and (b) to be moved in the sheet widthwise direction by the printing unit;

a support portion provided downstream of the printing unit in the conveyance direction, changeable between (a) a first posture at which the support portion forms a conveyance surface for a sheet and (b) a second posture, which is different from the first posture, at which the support portion protrudes from the conveyance surface, the support portion being capable of supporting a sheet from below; and a determination unit configured to determine, based on a detection result of the detection unit, whether the support portion is at the first posture or the second posture, wherein the support portion in the first posture supports a sheet with a first surface, and the support portion in the second posture supports a sheet with a second surface different from the first surface.

2. The apparatus according to claim 1, further comprising a pair of protruding portions provided so as to face each other in a conveyance path of a sheet by the conveyance unit, the pair of protruding portions being capable of supporting a sheet from below, wherein the support portion is located between the pair of protruding portions.

3. The apparatus according to claim 2, wherein each of the pair of protruding portions includes an inclined surface on an inward side.

4. The apparatus according to claim 3, wherein the support portion includes an inclined surface on at least one side in the sheet widthwise direction.

5. The apparatus according to claim 2, wherein the pair of protruding portions and the support portion are provided in a discharge path for discharging a sheet from a main body of the printing apparatus.

6. The apparatus according to claim 2, wherein the pair of protruding portions and the support portion are provided in a discharge tray configured to receive a sheet discharged from a main body of the printing apparatus.

7. The apparatus according to claim 1, wherein a recess portion configured to store the support portion in the first posture is provided in a conveyance path of a sheet by the conveyance unit.

8. The apparatus according to claim 1, wherein the determination unit acquires information indicating a sheet width of a sheet serving as a print target, and determines whether the support portion is at a position corresponding to the sheet width.

9. The apparatus according to claim 8, wherein the detection unit can detect presence/absence of a sheet being conveyed by the conveyance unit, and wherein the determination unit acquires, as the information, a detection result of the detection unit obtained during moving of the printing unit.

10. The apparatus according to claim 8, wherein if it is determined that the support portion is not at the position corresponding to the sheet width, the determination unit outputs a notification signal to notify a user of a determination result.

11. The apparatus according to claim 1, further comprising:

a first control unit configured to, before printing by the printhead is started, cause the conveyance unit to convey a sheet until at least a downstream end of the sheet is located on the support portion;

a second control unit configured to cause the detection unit to perform the detection while the moving is performed by the printing unit in a state in which at least the downstream end of the sheet is located on the support portion; and a third control unit configured to start printing by the printhead based on a determination result by the determination unit.

12. The apparatus according to claim 1, wherein in a case where, in a conveyance path of a sheet by the conveyance direction, a part in the sheet widthwise direction where the support portion is located is a first part, and a part other than the first part is a second part, wherein the detection result of the detection unit includes a first result corresponding to the first part and a second result corresponding to the second part, wherein the determination unit determines, based on the first result, whether the support portion is at the first position or the second position, and wherein the determination unit determines, based on the second result, a conveyed state of a sheet in the conveyance path.

13. The apparatus according to claim 1, wherein in a case where, in a conveyance path of a sheet by the conveyance direction, a part in the sheet widthwise direction where the support portion is located is a first part, the detection unit detects a distance to a sheet supported by the platen while the detection unit passes above the first part.

14. The apparatus according to claim 1, wherein the apparatus is configured to be capable of mounting a roll sheet, and further comprises a cutter unit configured to cut the roll sheet.

15. The apparatus according to claim 14, wherein the cutter unit is installed so as to be detachable from the printing unit.

16. A control method of a printing apparatus, the printing apparatus comprising: (1) a conveyance unit configured to convey a sheet in a conveyance direction; (2) a printing unit including a printhead that performs printing on a sheet conveyed by the conveyance unit, and configured to move the printhead in a sheet widthwise direction intersecting the conveyance direction; (3) a platen provided so as to face the printhead, and configured to support a sheet on which the printhead performs printing; (4) a detection unit mounted on the printing unit, and configured (a) to detect a distance to a sheet supported by the platen and (b) to be moved in the sheet widthwise direction by the printing unit; and (5) a support portion provided downstream of the printing unit in the conveyance direction, changeable between (a) a first posture at which the support portion forms a conveyance surface for a sheet and (b) a second posture, which is different from the first posture, at which the support portion protrudes from the conveyance surface, the support portion being capable of supporting a sheet from below, the method comprising:

determining, by detecting a distance to a sheet supported by the platen, whether the support portion is at the first posture or the second posture, wherein the support portion in the first posture supports a sheet with a first surface, and the support portion in the second posture supports a sheet with a second surface different from the first surface.

* * * * *